United States Patent [19]

Wolf

[11] Patent Number: 4,626,972

[45] Date of Patent: Dec. 2, 1986

[54] COMBINATION LAMP

[76] Inventor: Tobin Wolf, 1610 Harmon Cove Towers, Secaucus, N.J. 07094

[21] Appl. No.: 760,618

[22] Filed: Jul. 30, 1985

[51] Int. Cl.[4] ..... F21V 23/04

[52] U.S. Cl. ..... 362/251; 362/351; 362/411

[58] Field of Search ..... 362/410, 441, 251, 317, 362/351, 801

[56] References Cited

U.S. PATENT DOCUMENTS

| | | | |
|---|---|---|---|
| 1,721,176 | 7/1929 | Campo | 362/411 |
| 1,770,581 | 7/1930 | Paull | 362/410 |
| 2,012,413 | 8/1935 | Winkler | 362/411 |
| 2,449,765 | 9/1948 | Brattain | 362/410 |
| 2,673,966 | 3/1954 | Larkin | 362/411 |

FOREIGN PATENT DOCUMENTS

| | | | |
|---|---|---|---|
| 1146423 | 5/1957 | France | 362/411 |
| 481818 | 3/1938 | United Kingdom | 362/410 |

*Primary Examiner*—E. Rollins Cross

*Attorney, Agent, or Firm*—Jay M. Cantor

[57] ABSTRACT

The disclosure relates to a combination lamp and night light wherein the lamp also generates the illusion of a three-dimensional scene when the night light is operated. The scene is removably secured to the lamp base to permit changing of the scene.

8 Claims, 4 Drawing Figures

COMBINATION LAMP

BACKGROUND OF THE INVENTION

1. Field of the Invention

This invention relates to a combination table lamp and night light wherein the night light portion also generates an illusion of an illuminated three dimensional picture.

2. Brief Description of the Prior Art

Prior art table lamps are well known in the art. Such lamps are found with single and/or multiple bulbs, the bulbs being operable together or separately in accordance with the operation of a lamp switch. Such prior art table lamps, however, have not provided a mechanism to hold a child's interest under a low intensity lamp operating level which will assist in holding the child's attention and cause the child to sleep with a minimum of disturbance.

SUMMARY OF THE INVENTION

In accordance with the present invention, there is provided a combination table lamp and night light, operated by a single switch, wherein either the table lamp, the night light or both can be illuminated, the night light also providing illumination of minimal intensity through a scene which provides a three dimensional illusion, the scene being readily changeable by removal thereof from the lamp base and replacing it with a different scene. In addition, multiple scenes can simultaneously be displayed along different portions of the lamp base. The result is a standard table lamp which, in addition, operates only as a night light, but also provides the illusion of a three dimensional scene or scenes during night light operation to provide the above described beneficial effects therefrom.

DESCRIPTION OF THE PREFERRED EMBODIMENT

Figure 1:
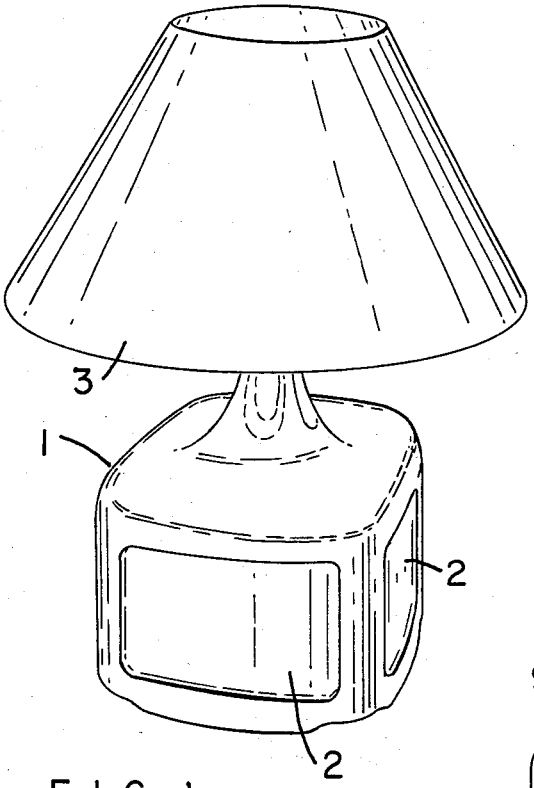
FIG. 1 is a perspective view of a lamp in accordance with the present invention.

Referring first to FIG. 1, there is shown a typical table lamp having a molded base 1 with a plurality of three dimensional pictures 2 in the base and a lamp shade 3 covering the bulb and switch mechanism which will be described hereinbelow.

Figure 2:
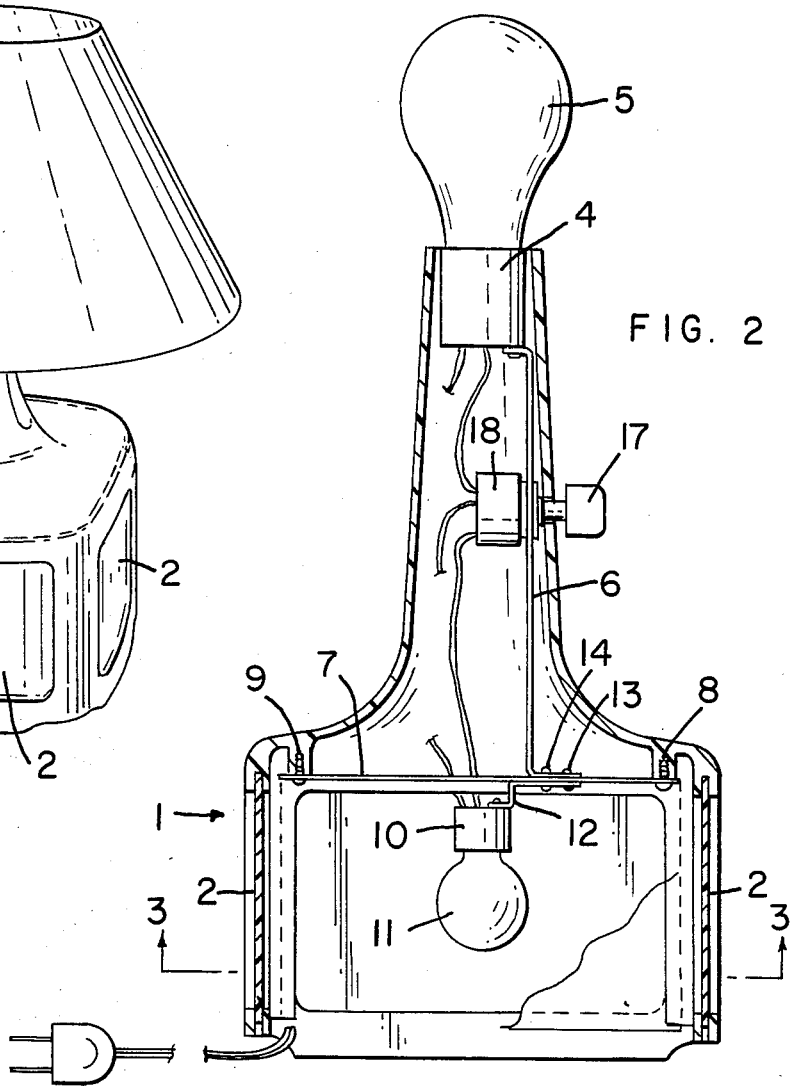
FIG. 2 is a vertical cross-sectional view taken through the center of the lamp in accordance with the present invention.
Figure 3:
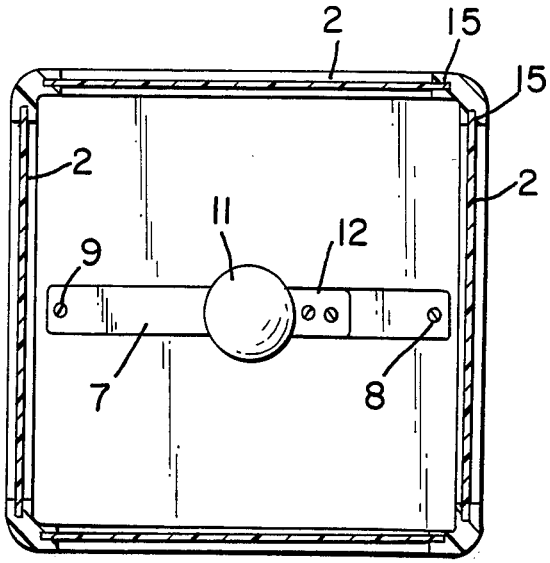
FIG. 3 is a view taken along the line 3—3 of FIG. 2.

Referring now to FIGS. 2 and 3, there is shown in greater detail the compound lamp in accordance with the present invention. Again there is shown the molded base 1 with three dimensional pictures 2 therein will be explained in more detail hereinbelow. A conventional bulb socket 4 holding a standard incandescent bulb 5 is supported within the base 1 of the lamp by a metal strap 6 joined to a horizontal metal strap 7 by means of rivets 13 and 14. The strap assembly 7 is fastened to the base 1 by means of screws or rivets 8 and 9.

Also fastened to the horizontal strap 7 is a lamp socket 10 holding a low wattage bulb 11 therein, the socket 10 being secured to the metal strap 7 by means of a strap 12 which is secured to the strap 7 by means of the rivets 13 and 14. The bulb 11 is preferably of low wattage such as, for example, 7½ watts or 10 watts, whereas the bulb 5 is preferrably of much larger wattage such as, for example, 100 watts. As a safety feature, the lamp socket 10 is preferrably of such dimensions so that it can accept only low wattage bulbs and may therefore accept a different bulb base than does the lamp socket 4.

A switch 18, operated by a knob 17 which rotates in the switch 18 serves to turn on the bulb 5 and then to turn off the bulb 5 and simultaneously turn on the bulb 11. The switch 18 then turns off both the bulbs 5 and 11. The switch 18 can also be designed to additionally turn on both bulbs 5 and 11 in its cycle though this is not contemplated herein. The rotary switch 18 is secured in the strap 6 in standard manner.

Figure 4:
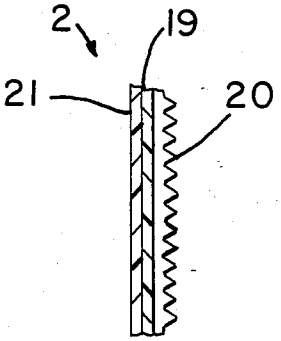
FIG. 4 shows a section of a typical three dimensional scene of the type which can be used in accordance with the present invention.

The three dimensional pictures 2 are slidably mounted in vertical grooves or tracks 15 by entrances in such grooves as can best be seen in the bottom portion of the lamp base in FIG. 2. The three dimensional pictures 2 are manufactured by several well known processes and often are seen as souvenir post cards and advertising matter. For example, Cowles magazine's xograph system for mass produced three dimensional printing can be used. These pictures generally comprise, as shown in FIG. 4, a special process transparent or translucent photograph or illustration 19, a lenticular sheet 20 and a protective backing 21. However, unlike the post cards or advertising matter, the backing 21 must be of translucent material to permit light to pass therethrough and must also be free of printed marks or messages.

In operation, assuming that the lamps 5 and 11 are initially in the off state, rotation of the knob 17 in the switch 18 will initially cause the lamp 5 to light with the lamp 11 being off. Further rotation of the knob 17 in the switch 18 will cause the lamp 5 to go off and the lamp 11 to go on. With the lamp 11 on, a very low level light will be produced and will pass through the three dimensional pictures 2 in the base of the lamp, thereby providing a combination of a night light as well as a scene of interest to a child which will draw the attention of the child thereto and provide the apparent advantageous results flowing therefrom. Further rotation of the knob 17 in the switch 18 will again cause the compound lamp to return to the initial off position with the lamps 5 and 11 both being off.

It can be seen that there has been provided a novel combination lamp which provides not only normal illumination and night light, but also, in addition, provides an aesthetic and pleasing scene to the viewer, preferrably a young child.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A combination lamp, which comprises:

(a) a lamp base, (b) switch means secured to said lamp base, (c) a first lamp socket securing a lamp therein disposed external of said lamp base, said first lamp socket being controlled by said switch means, (d) a second lamp socket securing a lamp therein disposed internal of said lamp base, said second lamp socket being controlled by said switch means; and (e) a light transmitting region in said lamp base for transmitting, external of said lamp base, light resulting from said lamp secured in said second lamp socket, (f) said light transmitting region comprising a first groove extending to an exterior surface of said base and disposed in said lamp base and extending in a plane substantially parallel to the axis of said lamp, a first translucent sheet removably secured in said first groove, said second lamp being disposed in said lamp base to project light through said translucent sheet.

2. A combination lamp as set forth in claim 1 wherein said light transmitting region is a translucent three dimensional appearing scene secured to said base.

3. A combination lamp as set forth in claim 1 wherein said light transmitting region is a light transmitting photograph having a lenticular sheet on one surface thereof and a translucent backing on the other surface thereof.

4. A combination lamp as set forth in claim 2 wherein said light transmitting region is a light transmitting photograph having a lenticular sheet on one surface thereof and a translucent backing on the other surface thereof.

5. The lamp of claim 1 wherein said light transmitting region further comprises at least a second groove remote from said frist groove extending to an exterior surface of said base and disposed in said lamp base and extending in a plane substantially parallel to the axis of said lamp, a second translucent sheet removably secured in said second groove, said second lamp being disposed in said lamp base to project light through said second translucent sheet.

6. The lamp of claim 2 wherein said light transmitting region further comprises at least a second groove remote from said first groove extending to an exterior surface of said base and disposed in said lamp base and extending in a plane substantially parallel to the axis of said lamp, a second translucent sheet removably secured in said second groove, said second lamp being disposed in said lamp base to project light through said second translucent sheet.

7. The lamp of claim 3 wherein said light transmitting region further comprises at least a second groove remote from said first groove extending to an exterior surface of said base and disposed in said lamp base and extending in a plane substantially parallel to the axis of said lamp, a second translucent sheet removably secured in said second groove, said second lamp being disposed in said lamp base to project light through said second translucent sheet.

8. The lamp of claim 4 wherein said light transmitting region further comprises at least a second groove remote from said first groove extending to an exterior surface of said base and disposed in said lamp base and extending in a plane substantially parallel to the axis of said lamp, a second translucent sheet removably secured in said second groove, said second lamp being disposed in said lamp base to project light through said second translucent sheet.

* * * * *